US010441992B2

(12) United States Patent
Swedberg

(10) Patent No.: US 10,441,992 B2
(45) Date of Patent: Oct. 15, 2019

(54) CAN BOTTOM FORMER ASSEMBLY

(71) Applicant: PRIDE ENGINEERING, LLC, Minneapolis, MN (US)

(72) Inventor: Rick Swedberg, Minneapolis, MN (US)

(73) Assignee: Pride Engineering, LLC, Minneapolis, MN (US)

( * ) Notice: Subject to any disclaimer, the term of this patent is extended or adjusted under 35 U.S.C. 154(b) by 359 days.

(21) Appl. No.: 15/411,822

(22) Filed: Jan. 20, 2017

(65) Prior Publication Data

US 2018/0207706 A1 Jul. 26, 2018

(51) Int. Cl.
*B21D 51/26* (2006.01)
*B21D 22/30* (2006.01)
*B21D 22/28* (2006.01)

(52) U.S. Cl.
CPC ..... *B21D 51/26* (2013.01); *B21D 22/30* (2013.01)

(58) Field of Classification Search
CPC ..... B21D 22/283; B21D 22/30
See application file for complete search history.

(56) References Cited

U.S. PATENT DOCUMENTS 5,378,010 A * 1/1995 Marino ..... B60G 11/183 267/259
5,380,028 A * 1/1995 Ferris ..... B60G 11/20 267/242
7,124,613 B1 10/2006 McClung
7,290,428 B2 * 11/2007 Zauhar ..... B21D 22/21 72/348
8,434,988 B2 * 5/2013 Tonti ..... B21D 51/26 413/27
2008/0302166 A1 12/2008 Frattini
2010/0251799 A1 10/2010 Gogola
2013/0037554 A1 2/2013 Monro

FOREIGN PATENT DOCUMENTS

WO WO 03072482 9/2003

OTHER PUBLICATIONS

PCT International Search Report and Written Opinion; PCT/US2018/013522; Printed & Received Mar. 18, 2018.
Preliminary Report on Patentability for PCT/US2018/013522; Received Aug. 1, 2019.

* cited by examiner

*Primary Examiner* — Christopher M Koehler
*Assistant Examiner* — Jared O Brown
(74) *Attorney, Agent, or Firm* — Neustel Law Offices

(57) ABSTRACT

An actuator assembly for dynamically or manually positioning a dome die and clamp ring of a can bottom former assembly. The actuator assembly is also usable for other purposes where accurate and repeatable adjustments in position are needed. The actuator assembly may include an anchor member and at least one torsion rod having a torque end and an actuation end, with 2 bends at or near the actuation end, such that a torque applied to the torque end creates a substantially linear actuation force at or near the actuation end of the torsion rod.

28 Claims, 8 Drawing Sheets

CAN BOTTOM FORMER ASSEMBLY

TECHNICAL FIELD

The embodiments described and claimed herein relate generally to bottom forming methods, systems, and devices for can manufacturing.

BACKGROUND

The present embodiments relate generally to assemblies used in the manufacture of metal containers. In the bottom forming process, there are a number of critical alignments and forces that affect the quality and repeatability of making cans of acceptable quality. In prior systems, the set up of the bottom-forming machinery relied in large part to the skill and experience of the person setting up the machinery. To improve this, there is a need for equipment that removes the guesswork from the setup process and eliminates detrimental variances due to inaccurate measurements, wear and other factors.

SUMMARY

In one aspect, an embodiment of the present system allows for positional adjustment of a bottom-former die set. Off-center hits from a can-forming punch can be detected using sensors, and as a result, the die set may be automatically or manually moved in a direction that more closely aligns the die set with the punch.

In another aspect, an embodiment allows for measurement and adjustment of air pressure that is in turn used to set or change the clamping force of the bottom former's clamp ring. The pressure can be automatically or manually adjusted to compensate for different can types, sizes, bottom geometry, etc.

In yet another aspect, an exemplary embodiment allows for the force applied by a dome-setting spring to be measured and adjusted, either manually or automatically. The measurement and adjustability provides the benefit of quantification of the setting force applied during the can-making process. In previous systems, the setting force was not measured, thus changes in the bottom former due to wear and age could have a detrimental impact on the quality of cans being produced.

DETAILED DESCRIPTION OF PREFERRED EMBODIMENTS

Figure 1:
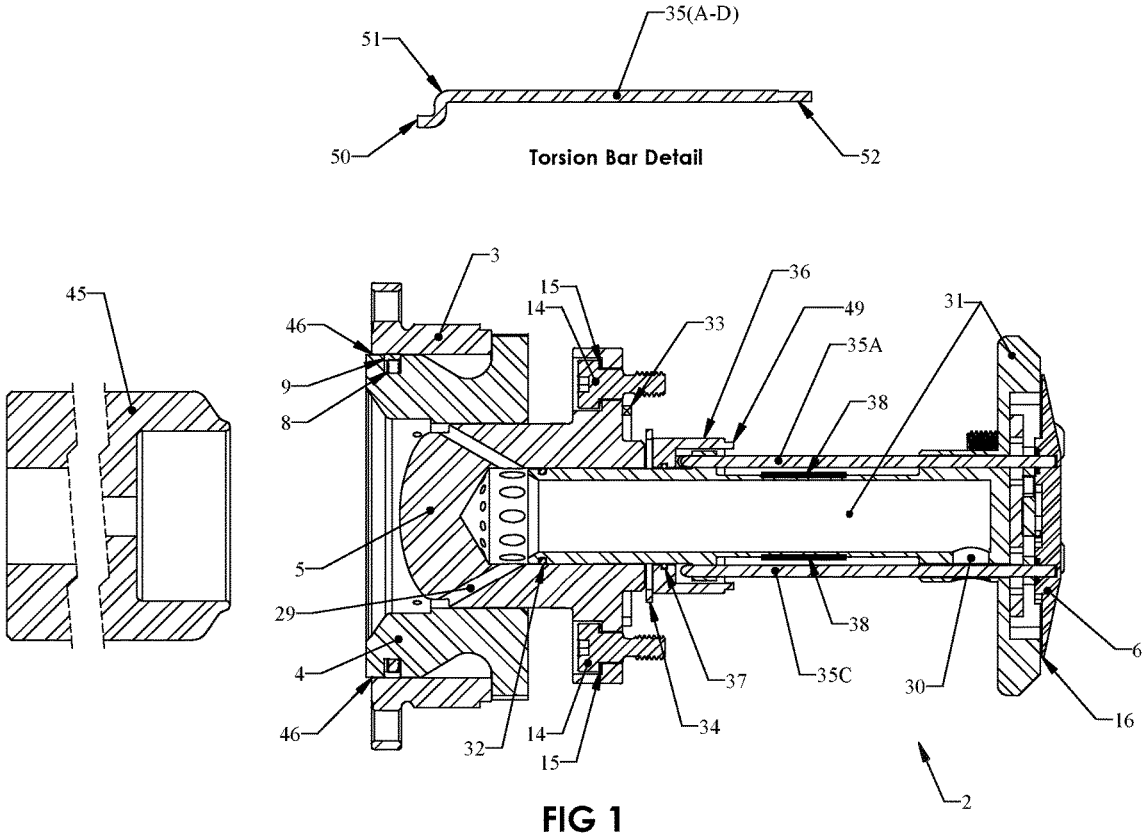
FIG. 1 is a section view of a die set sensing and adjustment assembly with punch.
Figure 2:
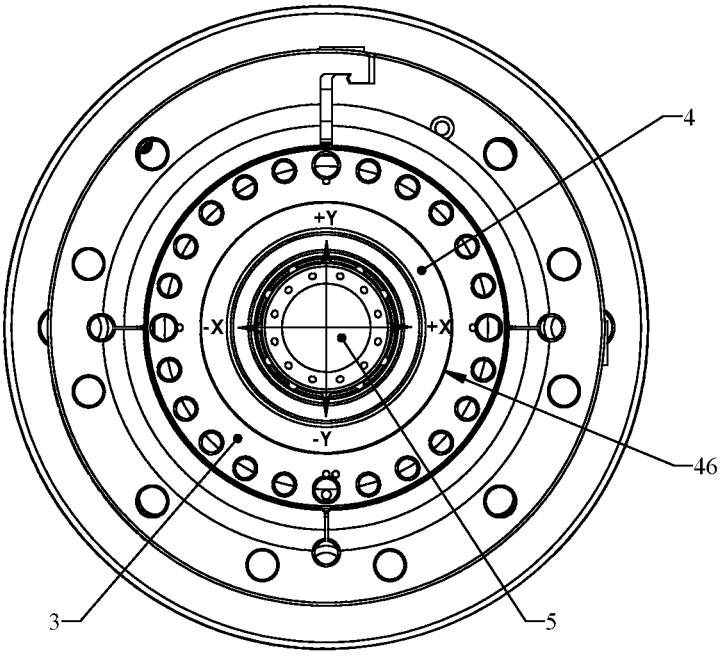
FIG. 2 is an end view of the bottom former viewed from the front.

The figures show a die set comprising a clamp ring 4 and a dome die 5. These act together, in conjunction with the can-forming punch 45, to form the structure of the bottom of a two-piece can. FIG. 1 shows the necessary gap 46 formed between the die set 4 & 5 and the clamp ring retainer 3. This gap is formed through the use of the "Floating Clamp Ring" design referenced above. The gap is small, typically between 0.005" and 0.015". This gap determines the amount of potential offset adjustment obtainable within the mechanism. The gap is evenly maintained through the use of an elastomer spring 8 and wear ring 9.

Still referring to FIG. 1, elastomer spring 8 and wear ring 9 are seated within a circumferential channel in clamp ring 4. Wear ring 9 is made of a wear-resistant material intended to provide a longer life than the O-ring interface material used in prior art floating clamp ring solutions. For example, the wear ring 9 may be constructed of a polyether ether ketone thermoplastic (PEEK) or a like low-wear material. Elastomer spring 8 is preferably constructed of a flexible compressible material and is constructed and arranged to compress radially. For example, the elastomer spring 8 may be constructed of a fluoroelastomeric or like polymeric material. The latter material compositions are formulated to function in high-temperature conditions. The elastomer spring 8 has a multi-faceted cross-sectional configuration and which is shown seated within a circumferential channel of the clamp ring 4. By being able to compress radially, elastomer spring 8 provides the flexibility required to allow contact from a misaligned punch to move the clamp ring 4 in a direction that improves its axial alignment with the punch and corresponding can body. The generally rectangular or multi-faceted shape of elastomer spring 8 is shown in FIG. 1 and is utilized with the cooperating wear ring 9, as opposed to an O-ring, as it increases the life of the material and prevents spiral failure of the material. Further, elastomer spring 8 provides greater surface area contact with wear ring 9, thereby providing a higher initial resistive force to reduce sagging of the clamp ring 4, which may result in misalignment.

Assuming the punch 45 strikes the bottom former die set 4 & 5 perfectly straight along the center axis, the motion of the die set 4 & 5 will be straight back into the bottom former. This condition is ideal for can making, but not obtainable in practice due to wear and tear on the can making equipment, initial set up inaccuracies, equipment speed changes and other variables. The floating die set 4 & 5 is designed to "float" around the center axis to match the position of the punch 45 as it engages the bottom former die set 4 & 5. In some embodiments of a floating clamp ring design, the fit between the clamp ring 4 and the dome die 5 may be a taper. Such a taper fit allows the clamp ring to rock on the fixed dome die 5 to facilitate the alignment feature. As shown in the embodiment of FIG. 1, the fit between the clamp ring 4 and the dome die 5 is a straight, tight fit. By using a straight fit, the dome die 5, in this design, is allowed to move with the clamp ring as it is manipulated. This is accomplished through the use of shoulder bolts 14. The holes through the dome die 5 are larger than the shoulder on the shoulder bolt, allowing off-center movement. This system is augmented through the use of spring washers 15 that keep a constant force on the dome die 5 along the punch travel axis. This force is also utilized to provide compression against the dome die environmental seal 33. This seal keeps coolant and lubricants from entering the bottom former cavity.

FIG. 1 shows the die set sensing and adjustment assembly 2 as it is assembled to the floating clamp ring 4 and dome die 5. The sensor support tube 31 has a friction fit into the cavity of the dome die 5 with a seal 32 to prevent coolant and lubricants from entering and contaminating the junction.

The friction fit allows any offset punch hit motion to be transferred into the thin walled portion of the sensor support tube 31, resulting in a bending moment. This bending moment creates strain on the walls of the tube 31. The strain is detected through an array of strain sensors 38 that are strategically placed around the diameter of the tube. The signals that are produced from these sensors 38 can be processed to indicate the direction and amplitude of the bending moment, thus indicating the position of the offset punch strike between the punch 45 and the bottom former die set 4 & 5.

The processed signals from the strain sensors 38 can be utilized by the operator during initial equipment setup to align the bottom former to the punch. The data can also be utilized to monitor the alignment during the can making process to indicate process and equipment problems and maintenance requirements. The data can also be utilized for process trending.

Figure 7:
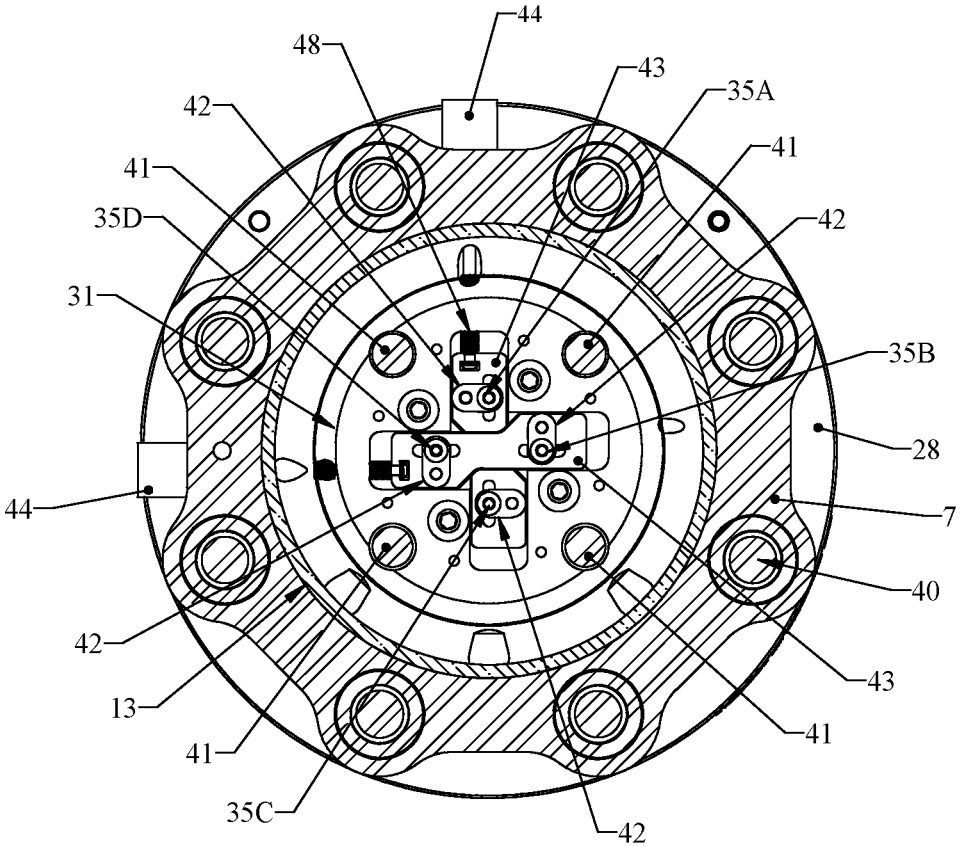
FIG. 7 is a section view of a bottom former showing a die adjustment mechanism.

Information from the strain sensors 38 can be utilized as well to make offset hit centering adjustments of the die set, within the bottom former itself, either manually or automatically in a feed-back loop. For example, the sensor information can be used to make adjustments to the position of the bottom former die set 4 & 5 dynamically during the can making process. As long as the sensors 38 continue to provide information that indicates punch 45 is making off-center hits, the information can be used to drive (electrically, pneumatically, or hydraulically) one or more of the actuators to improve the alignment of the die set 4 & 5 relative to the punch. As shown in FIG. 7, an array of actuators 44 can be either manually manipulated by use of a hand tool (such as a screwdriver or hex wrench), or automatically operated through the use of electric, pneumatic or hydraulic power. As just one example, actuators 44 can be driven by the manual or powered turning of a threaded component that translates into linear motion. During an adjustment operation, the strain sensors 38 can send electrical signals to an instrument that monitors the magnitude and direction of one or more off-center hits. This information is converted into signals that are sent to the actuators 44.

The actuators 44, through their linkage mechanisms 48, provide a linear force, in either direction, corresponding to the direction and distance required to center the bottom former die set 4 & 5 relative to the punch 45. In the case of manual manipulation, the offset hit information can be displayed for an operator to use during adjustment. To accomplish an adjustment of the x-y position of the dome die and clamp ring, the actuators 44 may be rotated or otherwise actuated, and movement of the linkage mechanisms 48 is transferred to the cross linkage shuttles 43. For example, if the top actuator in FIG. 7 is used, the vertical cross linkage shuttle 43, associated with torsion bars 35A and 35C, will move up or down.

The cross linkage shuttles 43 actuate the torsion rod linkages 42 through a common pin. As the torsion rod linkages 42 rotate, a torsional force is applied to the torsion bars 35. In the example described above, if the cross linkage shuttle moves up, a clockwise torsion will be applied to bar 35A, while a counterclockwise torsion will be applied to torsion bar 35C. It should be noted that, although a single, common shuttle 43 is shown, which can apply torque to two torsion bars at once, other configurations are possible. For example, an arrangement involving a single actuator providing torque to each torsion bar is possible.

The torsion bars 35 (four in the illustrated embodiment) extend through the die set sensing and adjustment assembly 2 to a position near the can-forming dies 4 & 5. The end of the torsion rod linkages 35 are formed in a manner to transfer the torsional force on them into a linear force that will act upon the sensor support tube 31 by way of a hole in the support tube through which the torsion rods pass near the bends in the rods. The linear force in turn moves die set 4 & 5 relative to the punch 45.

The torsion bar anchor ring 36 provides an anchor point for the opposing linear force produced by the torsion bars 35. The torsion bar anchor ring 36 is held in place in cylinder housing 7 (see FIG. 3) by a retainer ring 34 and is secured so as to prevent motion radially through a friction fit in a matching cavity in the cylinder housing 7. Rotation of anchor ring 36 is prevented by a securing tab 49 which fits into a matching slot in housing 7. In other words, the anchor ring 36 is held in place in all directions within cylinder housing 7. However, there is a clearance between the outer diameter of support tube 31 and the inner diameter of anchor ring 36, which allows support tube 31 to move relative to the anchor ring 36.

Figure 8:
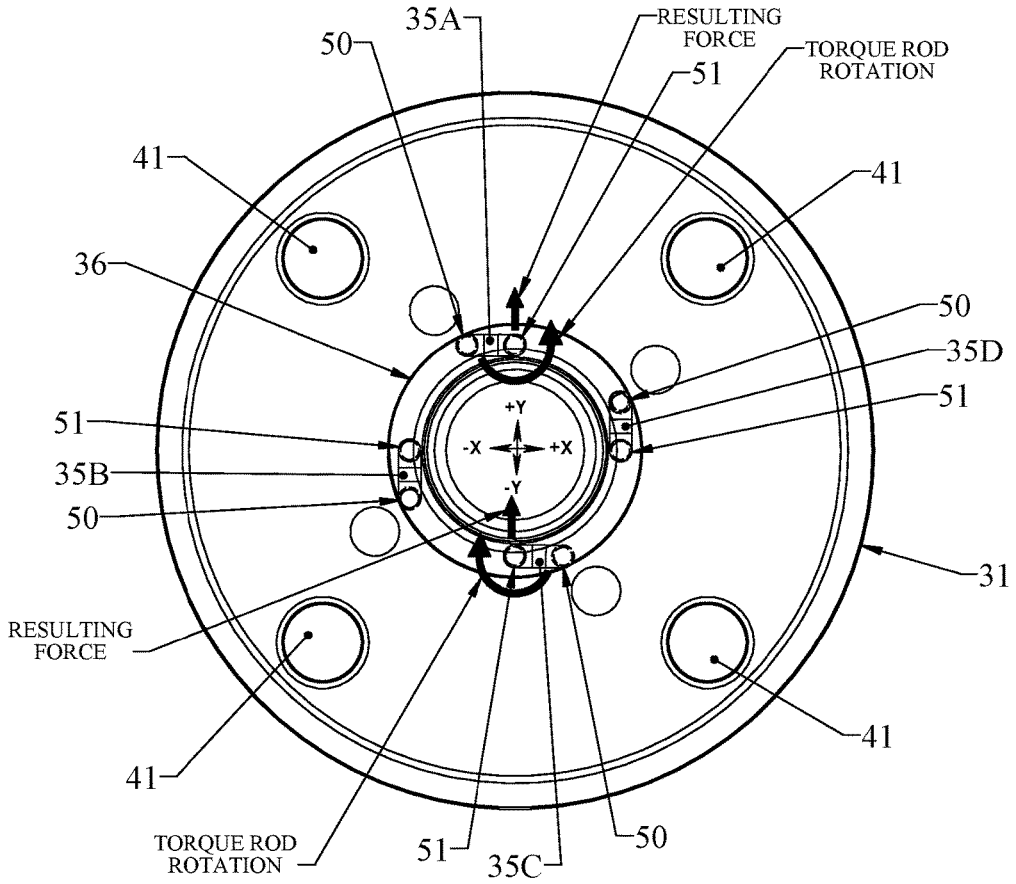
FIG. 8 is a section view of a bottom former showing a torque rod configuration.

The actuating force from the torsion bars 35 is applied to the sensor support tube 31 near, and providing motion radially, to the die set 4 & 5. Referring to the torsion bar detail in FIG. 1, x-y motion of support tube 31 is produced as follows: torque is applied at end 52 as described above. End 50 of tube 35 is held stationary by anchor ring 36. Accordingly, a linear motion in or out of the page is produced near bend 51. Since torque rod bends such as that indicated by 51 exist in all the torsion bars near the holes in sensor support tube 31 through which the torsion bars pass, x-y forces can be applied to the support tube 31 that in turn move the dome die 5 and clamp ring 4. This is also illustrated in FIG. 8. In the example here, where actuation results in torque being applied to the torsion bars in pairs and in opposite directions (clockwise and counterclockwise for each pair), the torque on both rods will result in resulting force (and thus motion) in just one direction—up in the illustration of FIG. 8.

The torsion bars 35 can be utilized alone or in combination to provide the desired deflection distance and direction required to center the die set 4 & 5 to the punch, while at rest or during the can making process. Because the torsion bars 35 and the sensor support tube are mechanically allowed to deflect while in any operational position, the strain sensors 38 remain functional and continue to sense die set 4 & 5 position changes applied to them from the punch 45, such as from off-center hits. The torsion bar anchor ring 36 contains an anchor ring seal 37 that provides protection from coolant and lubricant intrusion into the mechanisms behind it. The anchor ring seal 37 also allows the sensor support tube 31 to deflect. The linkage cover 6 protects the mechanism from contaminants utilizing a cover seal 16 between the linkage cover 6 and the sensor support tube 31.

Figure 3:
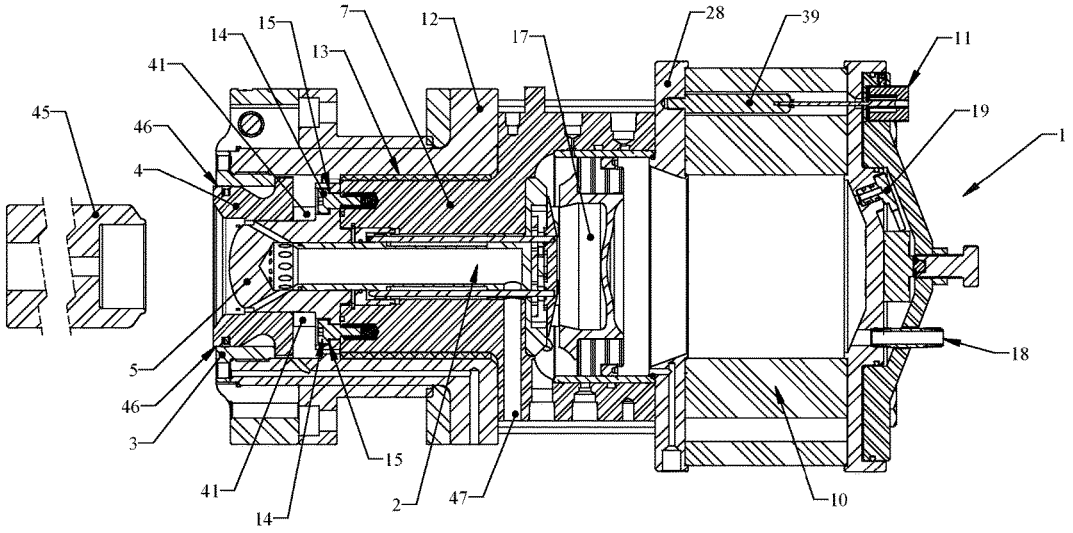
FIG. 3 is a section view of the bottom former viewed from the side.

The sensor support tube 31 is hollow to allow the passage of trapped coolant and lubricants, that are used in the can making process, from the coolant relief ports 29 in the dome die, to the coolant exhaust port 30. The coolant and lubricant is then expelled from the bottom former through an opening in the cylinder housing exhaust port 47 (FIG. 3).

Monitoring and Adjusting the Bottom Former Die Set Alignment

The die set sensing and adjustment assembly 2 in combination with the floating dome die 29 and the floating clamp ring 4 create a mechanism that allows adjustment to the alignment between the can-forming punch 45, the floating clamp ring 4 and the floating dome die 5. The changes in this alignment can be enacted either manually or automatically.

During the initial setup of the bottom former into the body-maker, standard mounting methods will be used. This will align the centerline of the can-forming punch 45 to the centerline of the floating clamp ring 4 and the floating dome die 5. This alignment is crucial to making proper cans. Any deviation of this alignment, in any direction, will adversely affect the quality and rate of production of cans through the body maker. During the can-making process, this alignment can shift due to many variables in the equipment. Variances in the speed of can production can also lead to misalignment problems.

The die set sensing and adjustment assembly 2 has a strain sensor array 38 surrounding a portion of the sensor support tube 31 as shown in FIG. 1. This sensor array sends electrical signals to a controller for display and manipulation. These signals are processed into directional force data and force amplitude data. This data is used to determine the direction and amplitude of the distance off center the can forming punch 45 is striking the bottom former die set. During the initial set up and alignment process, the user manually advances the can forming punch 45 into the bottom former die set 4&5. The controller will display the alignment information on the screen. Any indicated misalignment may be corrected by either manually adjusting the actuator linkages 48, or having the controller send a signal to one or both of the linkage actuators 44 to move the bottom former die set 4 & 5 into alignment. The controller will monitor the sensors during either adjustment type, manual or automatic, to determine when the strain sensors 38 begin to send a signal indicating further motion in the offset direction. This will indicate that the proper adjustment distance (x-y) has been achieved. The controller, or user, may or may not decide to reverse the adjustment a small amount for over compensation. The value of the strain gauge signals is then stored in the controller for reference, and the value of these signals is used in further calculations as a base alignment location. A secondary base location can be used, during the can making process, to establish position base points for comparison during operation. The nature of the tubular shape of the sensor support tube 31 and the spring wire composition of the torsion bars 35 allow the mechanism to flex after any alignment movement action. This allows the strain sensors 38 to continue monitoring the alignment during and after an alignment adjustment.

While the body maker is creating cans and the bottom former is creating the bottom geometry, the can-forming punch 45 alignment to the bottom former die set 4 & 5 may be monitored and displayed on the controller. This information can be displayed in such a fashion to allow the user to determine the direction and magnitude of the misalignment offset. As misalignment occurs during can production, the operator may manually adjust the alignment utilizing one or more of the actuator linkages 48, or the controller can send signals to one or more of the motion actuators 44 to adjust the alignment dynamically. This realignment process allows the can forming punch 45 to stay in alignment with the bottom former die set 4 & 5.

As the rate of can production through the body maker changes, the alignment between the can forming punch 45 and the bottom former die set 4 & 5 tends to change. Automatically readjusting the alignment can result in a higher rate of can production. In addition, the result of the components being aligned results in the creation of more cans within the proper specification. The alignment data collected can be stored and trended for determining longer term problems. These long-term problems may include body maker component wear, bottom former setup and alignment issues, bottom former components wear and variances in can material. The data can be stored and reproduced for use during change-out of can geometries and shared between body-makers and can plants.

Setting the Clamp Ring Force

Figure 5:
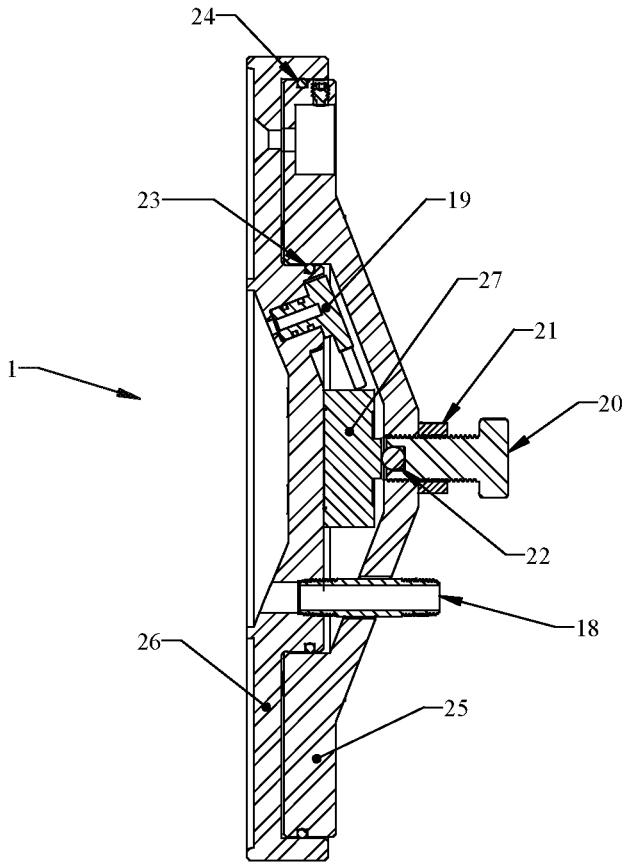
FIG. 5 is a section view of a setting force sensing and adjustment assembly viewed from the side.

During the bottom forming process, the punch 45, with the can material wrapped around it, strikes the clamp ring 4 first. As shown in FIG. 3, the clamp ring 4 provides pressure to the outer ring on the bottom of the can as the punch 45 moves into the bottom former (left to right in FIG. 3). This pressure supports the material, and clamps it between punch 45 and clamp ring 4, allowing the following doming process to stretch and set the material into the desired can bottom shape. The force on the clamp ring 4 is produced by the clamp ring pressure piston 17, and transferred to the clamp ring 4 through piston push rods 41. The force is generated through the use of compressed air, introduced through the compressed air inlet 18. The force on the clamp ring 4 is critical to creating the proper shape of the can bottom. As shown in FIG. 5, the cylinder pressure sensor 19, located in the setting force sensing and adjustment assembly 1, senses the pressure of the air acting on the clamp ring pressure piston 17. The signal generated by the cylinder pressure sensor 19 is utilized to verify the proper force is being applied to the clamp ring 4 during the can-making process. Adjustments to the pressure entering the compressed air inlet 18 can be made utilizing the signal from the cylinder pressure sensor 19. If a new type of can-bottom geometry or can making speed, or material changes are required, misformed cans are detected, or other factors require, the pressure can be manually or automatically adjusted and verified through the use of the cylinder pressure sensor 19 signal and either manually or automatically adjusting using electrical, pneumatic, or hydraulic actuators. Monitoring the cylinder pressure sensor 19 signal can also indicate issues in the can-making equipment that need to be addressed through maintenance.

Clamp Ring Pressure Control

The air pressure supplied to the compressed air inlet 18 can be set either manually or automatically. Air pressure can be supplied from an air pressure regulator and adjusted, as needed, manually. The air pressure, in this configuration, can be manipulated manually if there are changes to the can size, can bottom configuration or bodymaker can production rate. This leaves open the possibility that unacceptable cans will be created after can style changeout or bodymaker speed changes during production. By adjusting the air pressure introduced into the compressed air inlet 18 automatically, the pressure on the floating clamp ring 4 can be modified during a can geometry change over, or bodymaker speed change, without operator intervention. During an adjustment, in the automatic configuration, the pressure is manipulated by a controller. The pressure to be sent to the bottom former can be specified through a programmed look-up table or manipulated and stored by the operator through the controller's interface. The controller can constantly measure the air pressure and make adjustments in a feedback loop. The lookup table in the controller also has stored pressure data that corresponds to differing bodymaker speeds and differing can geometries and styles. These pressure settings can be used to adjust the pressure in accordance to the speed of the bodymaker during operation, as well as differing can geometries. This allows the floating clamp ring 4 force to be manipulated dynamically, during can production, to assure cans are made to specification. If the pressure falls out of a programmed tolerance window at any time, a fault can be logged in the controller. This fault signal can be used to inform the operator that maintenance must be performed on the bottom former or other equipment such as the bodymaker. The controller can also monitor the flow of the air being sent to the bottom former through the compressed air inlet 18. If the air flow is measured higher than a preprogrammed level, an error condition can be logged to warn the operator of potential clamp ring pressure piston 17 wear.

Monitoring and Adjusting the Dome Setting Force

Figure 6:
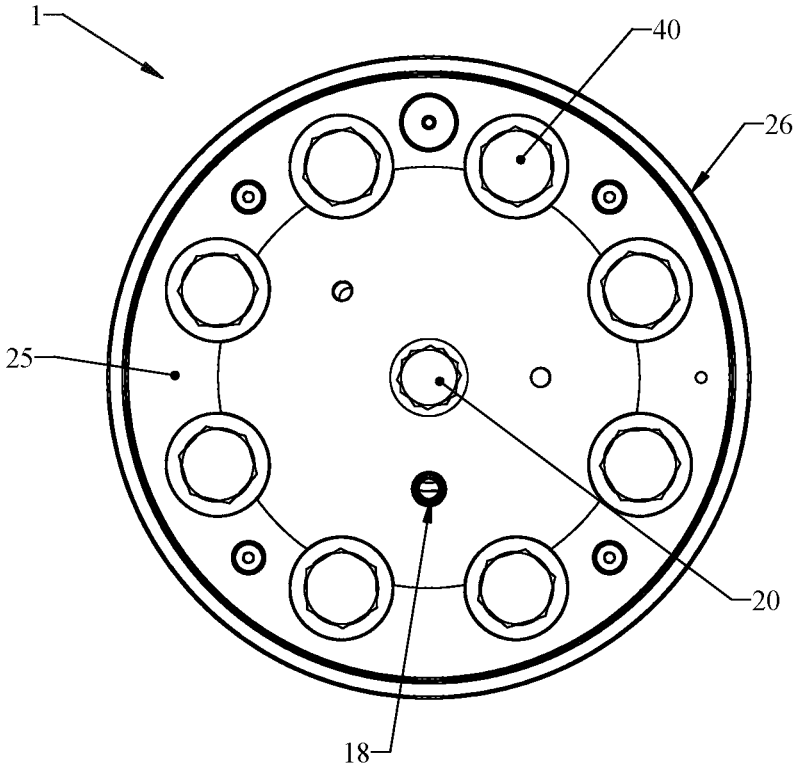
FIG. 6 is an end view of a bottom former viewed from the back.

Referring again to FIG. 3, as the clamp ring 4 travels into the bottom former (left to right), the dome die 5 presses the dome shape into the bottom of the can utilizing the can-forming punch 45 to support the shape. The clamp ring then strikes the dome die 5. The can-forming punch 45, the clamp ring 3 and the dome die 5 apply pressure to the cylinder housing 7, pushing it back a short distance while being supported by the outer housing bearing sleeve 13. The distance traveled is commonly called over travel. This over travel compresses the dome setting spring 10 through the spring cover plate 28. The force applied by the dome setting spring 10 is opposed by the inner end plate 26 (see FIG. 5) within the setting force adjustment assembly 1. The setting force adjustment assembly 1 contains the outer end plate 25 which is firmly anchored to the outer housing 12 through an array of tension bolts 40 (see FIGS. 6 & 7).

Figure 4:
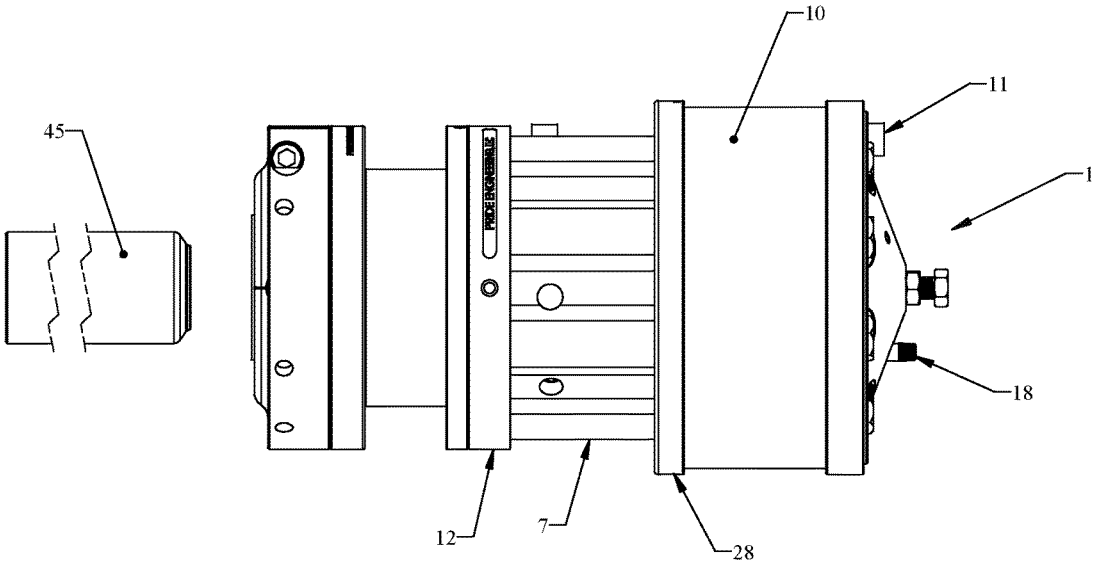
FIG. 4 is a side view of the bottom former with punch.

The force produced by the dome setting spring 10 (FIGS. 3 & 4) during the over travel sets the shape of the bottom of the can into the can material and is important to the can-making process. Typically the initial force provided by the dome setting spring 10 is fixed through the use of differing materials and set distance pre-tensioning. The measured force is not typically known during operation. The setting force adjustment assembly 1, best shown in FIG. 5, allows the operator to set the initial force of the dome setting spring 10 by adjusting the spring force setting screw 20 either manually or automatically through an actuator. The actuator, in the automatic configuration, may be electrical, pneumatic or hydraulic, and may be one of any number of common rotary actuators known to those of skill in the art.

Adjustments can be made to the dome setting force manually by loosening the force setting screw jam nut 21, adjusting the dome setting force by turning the spring force setting screw 20 in or out, and retightening the force setting screw jam nut to lock in the setting, which as discussed herein can be measured by sensor 27. The dome setting force can also be manipulated automatically by utilizing an electrical, pneumatic of hydraulic actuator. The dome setting force is critical to creating cans to the customer's specifications. This force, typically, is a set value and cannot vary during installation or operation. The ability to change this force, either during initial setup, can geometry changeover, or during the can-making operation, enhances the ability to produce better cans at any production speed.

By adjusting the dome setting force automatically, the force produced to set the dome in the bottom former can be modified during a can geometry change over, or bodymaker speed change, without operator intervention. During an adjustment, in the automatic configuration, the dome setting force is adjusted by the controller. The force to be sent to the bottom former can be specified by a programmed lookup table or manipulated and stored by the operator through the controller's interface. The controller is constantly measuring the force utilizing the force sensor 27 located in the setting force adjustment assembly 1 and making adjustments in a feedback loop. A lookup table in the controller also has stored force data that corresponds to differing bodymaker speeds. These force settings can be used to adjust the applied force in accordance to the speed of the bodymaker during operation. This allows the dome-setting force to be manipulated dynamically, during can production, to assure cans are made to specification. If the measured force falls out of a programmed tolerance window at any time, a fault can be logged in the controller. This fault signal can be used to inform the operator that maintenance must be performed on the bottom former or other equipment such as the bodymaker. The signal being received at the controller from the force sensor 27 can be analyzed for its signal shape. The shape of this waveform can be analyzed by the controller to indicate faults in the can making process induced by material changes, equipment components wear or other factors.

As the spring force setting screw 20 is advanced, increasing pressure is applied to the dome setting spring 10 through the force sensor 27 and the inner end plate 26. The adjustment can be locked in place with the force setting screw jam nut 21. A ball bearing 22 may be used to limit the torque applied to the force sensor during adjustment. The force sensor signal can be used to display the forces applied by the dome setting spring 10 or be processed to show the forces obtained throughout the over-travel event. This information can be fed back into the setting force adjustment assembly 1 for automatic adjustments required during operation. The force adjustment assembly 1 utilizes an inner environmental seal 23 and an outer environmental seal 24. These seals prevent coolant and lubricant from entering the force sensing and adjustment assembly 1, and also supply mechanical radial stability.

The setting force adjustment assembly allows the user to adjust the force being applied by the dome setting spring 10. During initial bottom former setup in the can plant, the user can adjust the amount of setting force, applied to the can material during the can-making process, by turning the spring force setting screw 20. The spring force setting screw 20 applies force to a force sensor 27. The force sensor 27 sends a signal to a device that displays the force readings. The user may then increase or decrease the setting force applied during the bottom-forming process. This benefits the user by being able to quantify the setting force being applied during the can making process. This knowledge is valuable for creating consistently accurate cans across all of the body maker machines in the can plant. The information can be used, as well, to bring consistency to multiple can plants if the data is shared between them.

The method for use, during initial bottom former setup, is to first assure the spring setting force screw 20 is backed out to the point that there is no force being applied to the dome setting spring 10. This is accomplished by backing out the setting force screw 20 and watching the displayed data from sensor 27 until the force displayed is near or at zero. The bottom former is then installed, and aligned, into the body maker in usual fashion. Assuring that the can forming punch 45 is retracted from the bottom former assembly, adjustments can be made to the setting force. These adjustments are made by turning the spring force adjustment screw 20 into the setting force adjustment assembly 1 while watching the force increase on the display. When the force reading on the display reaches the desired level, the adjustment is complete. If the body maker is to be changed over to create a different can geometry, the initial setting force can be changed to meet the requirements of the new can.

During the can-making process, the setting force may be monitored, at a high frequency, and displayed on the display unit as a pulse, for every can made, during the over-travel portion of the bottom forming process. The initial force, maximum force, and the presence of the force are monitored by the display unit. The data collected during the can making process can be utilized to indicate anomalies in the bottom former process. Changes to the initial setting force, as indicated by the level measured while not in over travel, and anomalies such as dome setting spring 10 wear may be witnessed. This allows the user to either adjust the force to a higher level or change the dome setting spring 10. Changes to the maximum force, as indicated by the measurement at the peak of the force pulse, may indicate anomalies such as can material thickness changes, body maker driveline equipment changes or other changes occurring in the process. These long-term problems may include body maker component wear, bottom former setup and alignment issues, bottom former component wear and variances in can material. The data can be stored and reproduced for use during change-out of can geometries and shared between bodymakers and can plants.

The over-travel distance is measured through the use of an over travel distance sensor 11 (see FIG. 3) and may be of inductive or LVDT sensor type. In the LVDT sensor type, the moveable sensor core is held in position with the sensor standoff 39. In the inductive sensor type, the sensor standoff 39 is used for the sensing surface. The position signal from sensor 11 may be used in combination with sensor 27 to further analyze or understand the over travel force applied by spring 10.

I claim:

1. An actuator assembly operated by torque, comprising:

an actuation member having a first end, a second end, and an axis, the first end having a fixed position relative to a housing, the actuation member having a length and being bendable along its length;

an anchor member spaced apart from the first end of the actuation member; and at least one torsion rod having a torque end and an actuation end, the at least one torsion rod further comprising a first bend and a second bend between the torque end and the actuation end, wherein the actuation end is pivotally connected to the anchor member and wherein the at least one torsion rod is pivotally coupled to the actuation member proximate the first bend, between the first bend and the torque end;

wherein a torque applied to the at least one torsion rod proximate to the torque end creates an actuation force having a translational component proximate the first bend of the at least one torsion rod; and wherein the actuation force displaces the second end of the actuation member in a direction substantially normal to the axis.

2. The actuator assembly of claim 1, wherein the actuation end of the at least one torsion rod is positionally anchored but allowed to rotate.

3. The actuator assembly of claim 2, further comprising a torsion rod linkage connected to the torque end of the at least one torsion rod to apply the torque.

4. The actuator assembly of claim 3, wherein the first bend and the second bend are configured to create the translational component of force due to a distance from the center of rotation of the actuation end and the first bend.

5. The actuator assembly of claim 1, wherein the at least one torsion rod comprises at least a first torsion rod and a second torsion rod, the first and second torsion rods being configured to create substantially equal translational forces on the actuation member.

6. The actuator assembly of claim 5, wherein the substantially equal translational forces are in substantially the same direction.

7. The actuator assembly of claim 6, wherein a rotational force component created by the first torsion rod is substantially counteracted by a rotational force component created by the second torsion rod.

8. The actuator assembly of claim 7, wherein torque is applied to the first and second torsion rods in opposite directions.

9. The actuator assembly of claim 1, wherein the at least one torsion rod comprises at least a first torsion rod and a second torsion rod, the first and second torsion rod being configured to create translational forces on the actuation member, the translational forces having different directions.

10. The actuator assembly of claim 9, wherein the translational forces are substantially perpendicular to each other.

11. The actuator assembly of claim 1, wherein the at least one torsion rod comprises a first pair of torsion rods and a second pair of torsion rods, and wherein the first pair of torsion rods comprises a first torsion rod and a second torsion rod, the first and second torsion rods being configured to create substantially equal translational forces on the actuation member in substantially the same direction, and wherein the second pair of torsion rods comprises a third torsion rod and a fourth torsion rod, the third and fourth torsion rods being configured to create substantially equal translational forces on the actuation member in substantially the same direction.

12. The actuator assembly of claim 11, wherein a rotational force component created by the first torsion rod is substantially counteracted by a rotational force component created by the second torsion rod, and wherein a rotational force component created by the third torsion rod is substantially counteracted by a rotational force component created by the fourth torsion rod, wherein the resulting translational forces of one or both torsion rod pairs move the actuation member.

13. The actuator assembly of claim 12, wherein torque is applied to the first and second torsion rods in opposite directions by a first cross linkage shuttle, and wherein torque is applied to the third and fourth torsion rods in opposite directions by a second cross linkage shuttle.

14. The actuator assembly of claim 13, wherein the first cross linkage shuttle is pivotally connected to the first and second torsion rods by first torsional linkages, and wherein the second cross linkage shuttle is pivotally connected to the third and fourth torsion rods by second torsional linkages.

15. The actuator assembly of claim 14, wherein the first cross linkage shuttle applies torque as a result of being moved by a first motion actuator, and wherein the second cross linkage shuttle applies torque as a result of being moved by a second motion actuator.

16. The actuator assembly of claim 15, wherein the first and second motion actuators are manually operated.

17. The actuator assembly of claim 14, wherein the first and second motion actuators are power operated.

18. The actuator assembly of claim 17, further comprising an array of strain sensors configured to measure force on the actuation member, wherein a signal from the array of strain sensors is used to position the actuation member by driving at least one of the motion actuators.

19. The actuator assembly of claim 18, wherein the first and second motion actuators are electrically powered.

20. The actuator assembly of claim 18, wherein the first and second motion actuators are pneumatic.

21. The actuator assembly of claim 18, wherein the first and second motion actuators are hydraulic.

22. The actuator assembly of claim 18, wherein the actuation member comprises a support tube, wherein movement of the support tube is used to position a dome die and a clamp ring of a can bottom former assembly.

23. The actuator assembly of claim 1, further comprising at least one strain sensor configured to measure force on the actuation member, wherein a signal from the at least one strain sensor is used to position the actuation member.

24. The actuator assembly of claim 1, further comprising at least one strain sensor configured to measure force on the actuation member, wherein a signal from the at least one strain sensor is used in a feedback loop to position the actuation member.

25. An actuator assembly operated by torque, comprising:

an anchor member; and at least four torsion rods, each torsion rod having a torque end and an actuation end and further comprising a first bend and a second bend between the torque end and the actuation end, wherein the torque ends of the at least four torsion rods are positionally anchored but allowed to rotate, and wherein the actuation ends are pivotally connected to the anchor member, wherein a torque applied to each torsion rod at the torque end creates an actuation force having a translational component proximate the first bend of each torsion rod; and wherein the at least four torsion rods comprise a first pair of torsion rods and a second pair of torsion rods, and wherein the first pair of torsion rods comprises a first torsion rod and a second torsion rod, the first and second torsion rods being configured to create substantially equal translational forces on the actuation member in substantially a first direction, and wherein the second pair of torsion rods comprises a third torsion rod and a fourth torsion rod, the third and fourth torsion rods being configured to create substantially equal translational forces on the actuation member in substantially a second direction.

26. The actuator assembly of claim 25, wherein the first direction and the second direction are substantially perpendicular to each other.

27. The actuator assembly of claim 26, further comprising an array of strain sensors configured to measure force on the actuation member, wherein a signal from the array of strain sensors is used to position the actuation member by actuating the torsion rods.

28. The actuator assembly of claim 27, wherein the actuation member comprises a support tube, wherein movement of the support tube is used to position a dome die and a clamp ring of a can bottom former assembly.

* * * * *